US006830660B1

(12) United States Patent
Yamauchi et al.

(10) Patent No.: US 6,830,660 B1
(45) Date of Patent: Dec. 14, 2004

(54) METHOD FOR PRODUCING METALLURGICAL COKE

(75) Inventors: Yutaka Yamauchi, Okayama (JP); Seiji Sakamoto, Okayama (JP); Katsutoshi Igawa, Okayama (JP); Shizuki Kasaoka, Okayama (JP); Toshiro Sawada, Okayama (JP); Koichi Shinohara, Okayama (JP); Yuji Tsukihara, Okayama (JP); Shinjiro Baba, Okayama (JP)

(73) Assignee: JFE Steel Corporation (JP)

( * ) Notice: Subject to any disclaimer, the term of this patent is extended or adjusted under 35 U.S.C. 154(b) by 0 days.

(21) Appl. No.: 09/509,381

(22) PCT Filed: Jul. 28, 1999

(86) PCT No.: PCT/JP99/04058

§ 371 (c)(1),
(2), (4) Date: Mar. 24, 2000

(87) PCT Pub. No.: WO00/06669

PCT Pub. Date: Feb. 10, 2000

(30) Foreign Application Priority Data

Jul. 29, 1998 (JP) ..... 10-214092

(51) Int. Cl.[7] ..... C10B 53/00

(52) U.S. Cl. ..... 201/21; 201/22; 201/23; 201/24

(58) Field of Search ..... 201/21, 22, 23, 201/24

(56) References Cited

U.S. PATENT DOCUMENTS 4,243,488 A * 1/1981 Sugimura et al. ..... 201/6

FOREIGN PATENT DOCUMENTS

| | | | | |
|---|---|---|---|---|
| JP | 52-23106 A | | 2/1977 | |
| JP | 53108103 A | * | 9/1978 | ..... C10B/57/04 |
| JP | 54-117501 A | | 9/1979 | |
| JP | 57-162778 A | | 10/1982 | |
| JP | 57-187384 A | | 11/1982 | |
| JP | 59-179584 A | | 10/1984 | |
| JP | 02-127495 A | | 5/1990 | |
| JP | 07-157769 | | 6/1995 | |
| JP | 07-197030 | | 8/1995 | |
| JP | 07-268349 | | 10/1995 | |

* cited by examiner

*Primary Examiner*—Walter D. Griffin
*Assistant Examiner*—James Arnold, Jr.
(74) *Attorney, Agent, or Firm*—Piper Rudnick LLP

(57) ABSTRACT

In a method of producing coke for metallurgy by carbonizing a coal blend obtained by blending plural raw coals in an coke oven, a coal blend containing not less than 60 wt % of a medium coking coal of middle coalification degree and low fluidity having an inert component content of not less than 30% is used as a coal charged into the coke oven, whereby a great amount of raw coal of a brand being cheap and easily available can be blended in a great amount and hence coke for metallurgy having an excellent quality such as strength or the like can be produced by blending few brands of coals as compared with a coal blend of many brands.

7 Claims, 4 Drawing Sheets

X-coal:Y-coal:C-coal:A-coal=81-y:y:10:9
y=0~81

METHOD FOR PRODUCING METALLURGICAL COKE

TECHNICAL FIELD

This invention relates to a method of producing coke for metallurgy, and more particularly a method of producing high-strength coke for metallurgy capable of using in a large size blast furnace by blending a great amount of brand coal near to the quality of a coal blend for the charge in a coke oven to form the coal blend consisting of only a few brands of coals without blending many brands of coals.

BACKGROUND ART

When making molten iron in a blast furnace, it is first necessary that iron ores and coke are alternately charged into the blast furnace and filled therein in the form of layers. The iron ore and coke are heated by hot air of high temperature blown through a tuyere and at the same time the ore is reduced to iron by CO gas generated through combustion of coke.

In order to stably conduct the operation of such a blast furnace, it is required to ensure air permeation and liquid permeation in the furnace, and hence it is inevitable to use coke having excellent properties such as strength, particle size, strength after reaction and the like. Among them, the strength (drum strength) is considered to be an important property.

In the production of such coke for the blast furnace, it is required to carbonize the coal blend (charging coal) for charging into a coke oven having a constant coking property and coalification degree. For this purpose, a raw coal having a good quality (which is mainly called by a production area, and is called as a brand) is necessary. Recently, such brands of coals (hereinafter referred to as a "raw coal") is difficult to obtain in a great amount. Therefore, there has been used a so-called "coal blend" obtained by blending many kinds of the raw coals having different properties in accordance with the production country and production area (usually 10~20 brand coals).

In such a coal blend, it is common to blend coal of one brand in an amount of not more than 20 wt % at most. This blending thought lies in that the raw coals are blended so that a quality of coke obtained by carbonization of the coal blend in a coke oven is made to be not less than a certain level. For example, it is enough to balancedly blend fibrous components forming a skeleton of coke (which is evaluated by the coalification degree of coal using volatile component, C wt %, vitrinite reflectance and the like as an indication) with coking component forming an aggregate through coking of coal particles (there are fluidity of coal, expansion degree, tackiness index and the like as an indication). That is, the strength of coke after carbonization is guessed obtained by calculating the quality as the coal blend based on coalification degree and coking property of each brand of raw coals.

At the present, 10~20 brands of raw coal are usually blended as a coal (coal blend) charged into the coke oven used for the production of coke for a blast furnace. According to this method, the influence of the properties of the raw coal per one brand upon the qualify of the coke as a final product becomes small. Therefore, even in the case of coal unsuitable for the production of coke for blast furnaces, it may be blended only in a small amount, and serves to stabilize the quality of coke as a merit.

As to the raw coals blended for the production of coke for blast furnace, however, it is presently used to select only coals having relatively good quality as compared with coal used for the production of general-purpose coke. Therefore, the iron-making technicians are always troublesome in the saving of good quality coals as it is.

Among the raw coals being cheap and available in a greater amount, for instance, there is medium coking coal having a high content of inert component indicating a mean reflectance of 0.9~1.1 and a maximum fluidity of not more than 3.0. And also, such raw coals have substantially the same quality property as in the above usual coal blend. According to the inventors' study, however, when a greater amount of this raw coal is blended and carbonized, the desired coke strength can not actually be obtained though the quality is similar to that of the coal blend, and hence it is difficult to use it in a greater amount.

On the other hand, according to the conventional method of blending many kinds of raw coals having a certain quality, e.g. about 20 brands of coals must be always stocked in a coal yard. This causes problems in the yard site such as the cost for unloading and quarrying becomes expensive and the like.

In the conventional technique, it is required to adjust and blend many brands of raw coals as a coal blend to be charged into the coke oven as mentioned above. However, the raw coal to be blended is difficult to get in accordance with the brand thereof, or even if such raw coals are obtained, there is a problem in the maintenance of the raw coals in the stock yard.

Under the above circumstances, it is, therefore, an object of the invention to provide a method of advantageously producing coke for metallurgy having an excellent quality such as strength and the like as compared with the conventional method, particularly high-strength coke capable of use in a large-size blast furnace by blending a greater amount of a brand of a raw coal being cheap and easily available with several brands of raw coals.

DISCLOSURE OF INVENTION

The inventors have made various studies with respect to the kinds of raw coals and the blending thereof in order to achieve the above object and found that there is a combination suitability or affinity in a combination of so-called particular brands of raw coals because the coke strength is largely shifted from that estimated from a weighted mean value of each raw coal in accordance with the method of combining raw coals of different production countries (each brand coal). That is, it has been confirmed that the strength required as a coke for metallurgy is obtained by utilizing the affinity of particular brands of raw coals with the other brand of raw coals even if the raw coal is restricted to a few brands and these brands are blended, and as a result the invention has been accomplished.

That is, the invention lies in a method of producing coke for metallurgy by blending plural brands of raw coals to form a coal blend and carbonizing it in a coke oven, characterized in that a coal blend containing not less than 60 wt % of medium coking coal having a content of inert component of not less than 30%, a middle coalificiation degree and a low fluidity is used as a coal charged into the coke oven.

In the invention, the above medium coking coal of middle coalification degree and low fluidity is favorable to have a equilibrium moisture content of not less than 3.5%.

In the invention, it is favorable that the coal blend consists of 60~95 wt % of the medium coking coal having the middle coalification degree and low fluidity and 5~40 wt % of hard coking coal and/or medium coking coal having a high coalification degree and/or a middle-high fluidity.

In the invention, it is favorable that one or more raw coals having an mean reflectance ($R_0$) as the coalification degree of 0.9~1.1 and a maximum fluidity (MF) as a coking property of not more than 3.0 are used as the medium coking coal having the middle coalification degree and low fluidity.

In the invention, it is favorable that either one or more of high coalification coking coal having an mean reflectance ($R_0$) as the coalification degree of not less than 1.3 and middle-high fluidity coking coal having a maximum fluidity (MF) of not less than 3.0 are used as the hard coking coal and/or medium coking coal having the high coalification degree and/or middle-high fluidity.

In the invention, the product coke is favorable to indicate of a tumbler strength (TIE) of not less than 83%.

According to the method of the invention having the above construction, raw coals being cheap and available in a great amount can be blended in a greater amount, so that it is possible to stably ensure coke for a large-size blast furnace having an excellent quality indicated by TIE of not less than 83%, preferably not less than 84% even when the coal blend is formed by blending raw coals of brands smaller than the conventional brand number.

BEST MODE FOR CARRYING OUT THE INVENTION

An embodiment of the invention will be described in detail.

Figure 1:
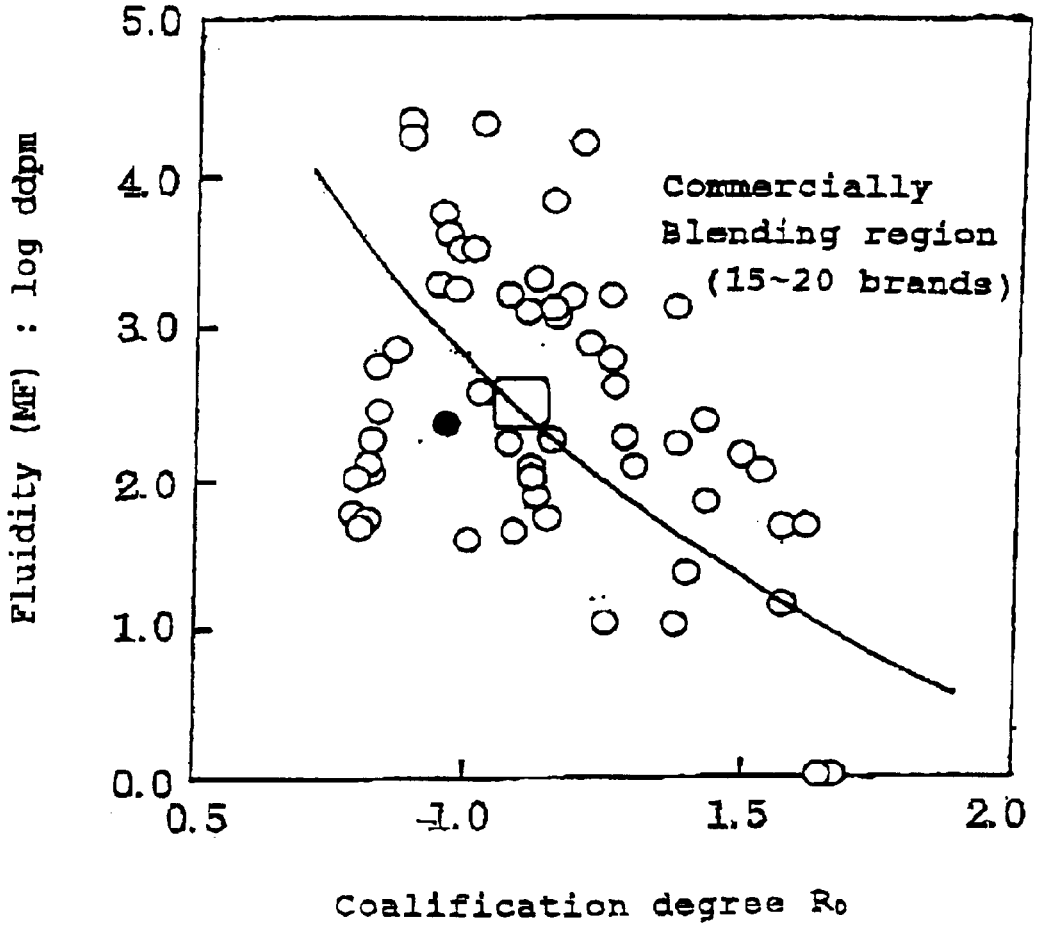
FIG. 1 is a graph showing properties of middle coalification and low fluidity coal and general-purpose coal blend.

FIG. 1 is a graph showing indicating qualities of main brands of raw coals (64 brands) imported in Japan at the present time, wherein the abscissa is a coalification degree $R_0$ of coal (as $R_0$ becomes higher, the coke strength in the carbonization increases) and the ordinate is a fluidity MF of coal (indication of coking property of coal).

As the present time, as a coal blend charged into a coke oven, 10~20 brands of raw coals among raw coals imported in Japan are blended so as to adjust the properties to coalification degree $R_0$=9~1.2 and fluidity MF=about 2.3~3.0.

For instance, the inventors have particularly noticed examined the particular brands of raw coals and found that medium coking coal having a middle coalification degree and a low fluidity (hereinafter referred to as middle coalification-low fluidity coal) tested is shown by a black circle in FIG. 1 and is approximately equal to a grade of coal blend having a coalification degree $R_0$=1.05 and a fluidity MF=2.4 (charging coal). This means that it is possible to blend a greater amount, for example, not less than 50% of such a middle coalification-low fluidity coal. According to the inventors' studies, however, it has been confirmed that when the middle coalification and low fluidity coal is merely blended in a greater amount, the coke strength considerably lowers and is unsuitable as the coke for metallurgy. As a result of searches, there are considered various causes that the equilibrium moisture content in the total water content of 7.5% is as high as not less than 3.5% (usual raw coal is about 2.5%) and the like. Among them, it has been confirmed that a maximum cause lies in a point that the inert component such as fusinite, semi-fusinite or the like as a coal structure component is 10~less than 30% in the usual raw coal and as high as 40~50 wt % in the middle coalification and low fluidity coal.

To this end, the inventors investigated the "affinity" as a blending property of the coals and examined on the combining affinity of the middle coalification and low fluidity coal with the other brands of reinforcing coking coals, particularly hard coking coal and medium coking coal. That is, various coal blends are prepared by blending the middle coalification and low fluidity coal with several kinds of strength-reinforcing coking coals shown in Table 1 and the coal blends are subjected to carbonization test in a coke oven.

Figure 2:
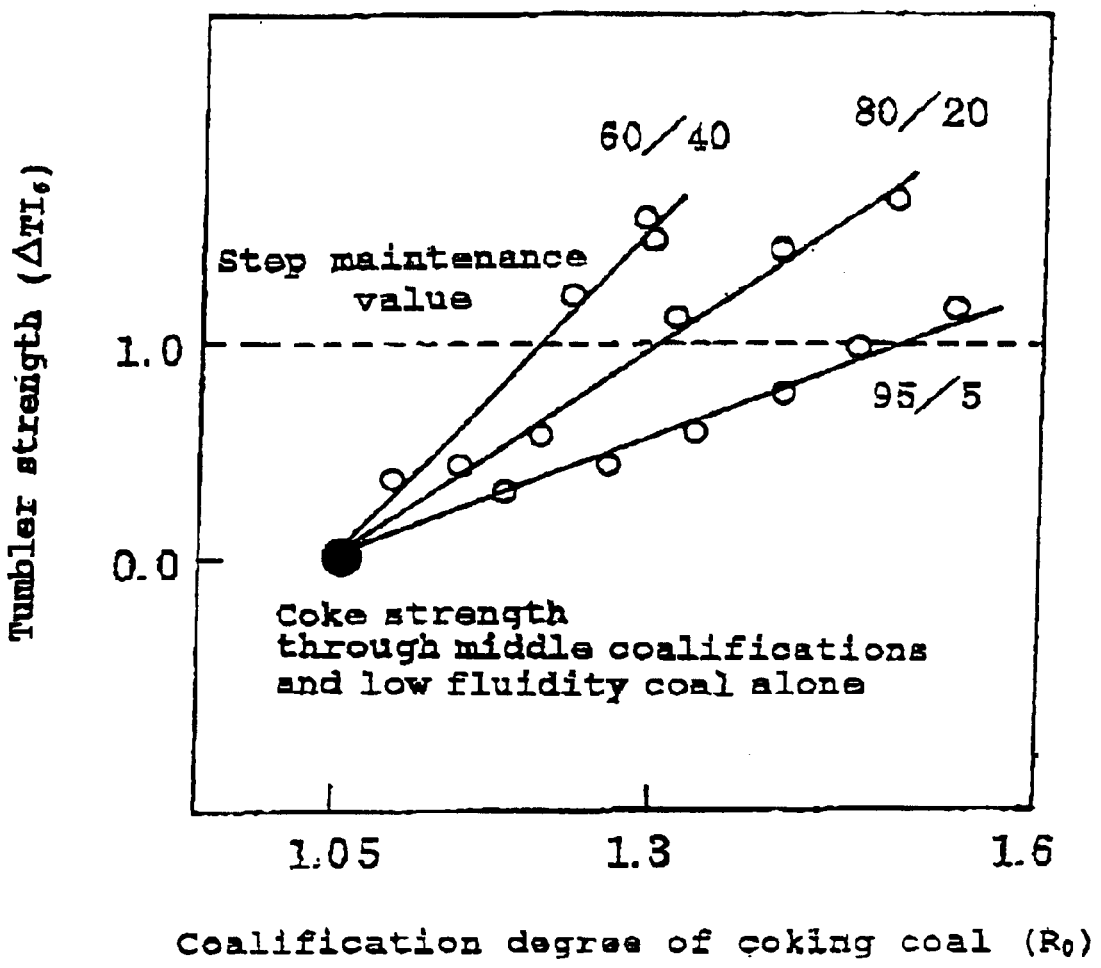
FIG. 2 is a graph showing the influence of the blending ratio of middle coalification and low fluidity coal and a hard coking coal upon coke strength (tumbler strength).

As a result, it has been confirmed that the coke strength (tumbler strength) required as a coke for metallurgy is obtained when the blending ratio of the middle coalification and low fluidity coal to the strength reinforcing coal of other brand (hard, medium coking coal) is within a range of 60-40~95/5 as shown in FIG. 2.

FIG. 2 is a graph showing an the effect of improving the tumbler strength $TI_6$ when the strength of the coke made from only the middle coalification and low fluidity coal is zero, which shows a comparison the strength of coke made from only the middle coalification and low fluidity coal and the tumbler strength of two coal blend obtained by blending the middle coalification and low fluidity coal and the other brand of strength-reinforcing coking coal. The numerical value in the figure shows the blending ratio of the middle coalification and low fluidity coal and the other brand coal.

Moreover, the tumbler strength as a strength of coke is indicated by a value as measured in an amount of not less than 6 mm after a sample is rotated at 400 revolutions using a tumbler strength testing machine described in JIS K2151 and then screened.

TABLE 1

| Brand of Coal | Mean reflectance $R_0$ | Maximum fluidity MF | Tumbler strength*) $\Delta TI_6$ (%) |
|---|---|---|---|
| Middle coalification and low fluidity coal (X-coal) | 1.05 | 2.40 | — |
| Reinforcing coals | | | |
| A | 1.59 | 1.63 | 1.1 |
| B | 1.57 | 1.42 | 0.9 |
| C | 1.46 | 2.37 | 0.7 |
| D | 1.38 | 1.22 | 0.5 |
| E | 1.23 | 1.60 | 0.3 |
| F | 1.14 | 4.08 | 0.2 |

*)$\Delta TI_6$: Change of tumbler strength when a blending ratio of X coal/i coal (i = A–F) is 95/5

As mentioned above, it has been confirmed that when the middle coalification and low fluidity coal (X-coal) is blended with 5~40 wt % of the reinforcing coking coal (A~F) being the other brand raw coal shown in Table 1, even if the coal is blended in a greater amount, the coke strength ($Tl_6$>83) can sufficiently be ensured and the coke strength of a target as a measure (step maintenance value) usable in a large size blast furnace of 3000~5000 $m^3$ class is obtained. In this case, when the blending amount of the other reinforcing hard coking coal (A~F) is less than 5 wt %, the strength is lacking, while when the blending amount of the other reinforcing hard coking coal (AF) is more than 40 wt %, the blending effect is saturated and the economical merit is lost.

And also, as the mean reflectance (coalification degree: $R_0$) of the hard coking coal being the strength-reinforcing coal (A~F) becomes higher, the improving effect of the coke strength becomes higher, which means the middle coalification and low fluidity coal can be used in a greater amount. Moreover, the blending of the strength-reinforcing hard coking coal may be alone or in admixture of plural coals-because the effect to the coke strength is the same. However, when the number of coals is too large, the subject of the invention combining few brands of coals is conflicting, so that 3–4 kinds are suitable at most.

Since the hard coking coal used for the reinforcement is expensive, it is desirable to control the blending ratio of the hard coking coals in view of the cost.

For this purpose, in the invention, it is desirable that the middle coalification and low fluidity coal is blended with at least one of coking coals having a coalification degree $R_0$ larger than the mean reflectance (coalification degree) of the former coal such as high coalification hard coking coal and high coalification medium coking coal. That is, when raw coals (high coalification hard coking coal, high coalification medium coking coal) of a brand indicating a coalification degree of not less than 1.3 as a property of the coking coal is blended in an amount of 5~40 wt %, preferably about 5~20 wt %, the effect of improving the coke strength becomes remarkable.

Further, when the middle coalification and low fluidity coal is blended with 5~40 wt %, preferably 5~20 wt % of middle-high fluidity hard coking coal or medium coking coal indicating maximum fluidity MF larger than the maximum fluidity MF of the former coal or MF value of not less than 3.0, the coke strength can be surely increased. This may be also used in the blending of the above high coalification coking coal.

As mentioned above, according to the invention, it is favorable to blend the middle coalification and low fluidity coal with hard coking coal or medium coking coal having high coalification degree and/or middle coalification degree as a raw coal for the reinforcement of the coke strength.

As the middle coalification and low fluidity coal, the production country and production pip area are not particularly restricted, and use may be made of ones similar to coal having large inert component and equilibrium moisture content and the aforementioned properties. That is, as shown in Table 2, Y-coal as a raw coal similar to the properties of the middle-coalification and low fluidity coal is a coal having similar properties except that volatile matter (VM) and maximum fluidity (MF) are slightly high and the mean reflectance ($R_0$) is slightly low. Such raw coals are coals being difficult to use in the conventional blending method likewise the aforementioned middle coalification and low fluidity coal. However, Y-coal can be applied to the blending of few brands of raw coals likewise the above middle coalification and low fluidity coal.

Moreover, the raw coals having similar properties (Y-coal etc.) may be used together because the mean reflectance ($R_0$) is within a range of 0.9~1.1 and the maximum fluidity (MF) is not more than 3.0 like the middle coalification and low fluidity coal.

TABLE 2

| | Total | | | | | Maceral analysis | | |
|---|---|---|---|---|---|---|---|---|
| Brand | Volatile matter VM | Fixed carbon FC | sulfer content TS | Maximum fluidity MF | Mean reflec-tance | Vitrinite (Vt) | Semi-fusinite (SF) | Fusinite (F) |
| X-coal (middle coalification and low fluidity coal) | 27.1 | 65.7 | 0.43 | 2.420 | 1.073 | 51.0 | 46.0 | 1.5 |
| Y-coal | 28.7 | 62.8 | 0.40 | 2.780 | 1.044 | 56.0 | 33.6 | 5.2 |

EXAMPLE 1

X-coal is used as the middle coalification and low fluidity coal as a main raw material as shown in Table 3. A coal is used as an example of high coalification coking coal used for the reinforcement of the strength. C-coal is used as a medium coking coal or hard coking coal indicating a mean reflectance higher than that of middle coalification and low fluidity medium coking coal. A coal blend for charging into a coke oven is prepared by blending them at a ratio of X-coal: A-coal: C-coal=8:9:10. The properties of each of these coals are shown in Table 3.

TABLE 3

| Brand | Volatile matter VM | Ash content Ash | Fixed carbon FC | Total sulfer content TS | Crucible swelling index CSN | Maximum fluidity MF | Mean reflec-tance $R_0$ |
|---|---|---|---|---|---|---|---|
| X-coal (middle coalification and low fluidity coal) | 27.1 | 7.2 | 65.7 | 0.43 | 6 | 2.42 | 1.073 |

TABLE 3-continued

| Brand | Volatile matter VM | Ash content Ash | Fixed carbon FC | Total sulfer content TS | Crucible swelling index CSN | Maximum fluidity MF | Mean reflectance $R_0$ |
|---|---|---|---|---|---|---|---|
| A-coal | 18.3 | 9.3 | 72.4 | 0.21 | 9 | 1.505 | 1.588 |
| C-coal | 28.1 | 9.1 | 62.8 | 0.67 | 7 | 3.959 | 1.117 |

Figure 3:
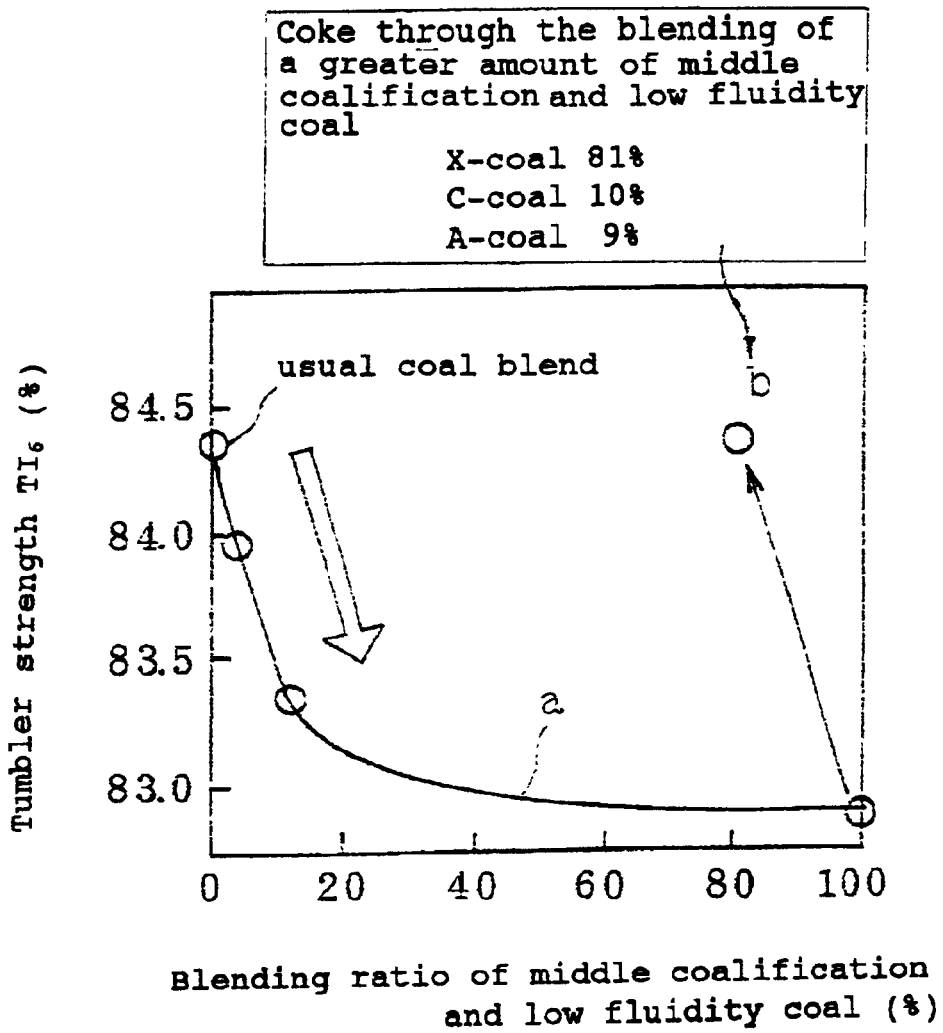
FIG. 3 is a graph showing the relation between the blending ratio of middle coalification and low fluidity coal and coke strength.
Figure 4:
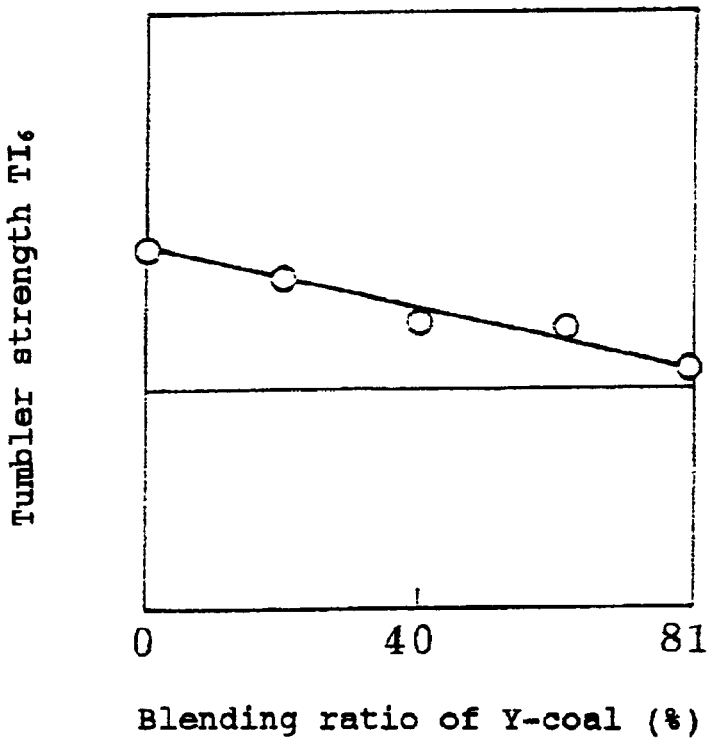
FIG. 4 is a graph showing the relation between the blending ratio of middle coalification and low fluidity coal and coke strength when blending two middle coalification and low fluidity coals having similar properties.

And also, FIG. 3 shows an the influence of the blending ratio of the middle coalification and low fluidity coal upon the strength. As shown in the figure, when the blending ratio of coal blend blending the middle coalification and low fluidity coal is increased, the strength ($Tl_6$) paid gradually lowers as shown by "a" as compared with the coke strength of usual coal blend ($Tl_6$=84.4%), but the strength is obtained at a level approximately equal to that of the usual coal blend in case of the above blending ratio (X-coal:C-coal:A-coal= 81:10:9) as shown by "b.

In the production method of coke for metallurgy blending a greater amount of the middle coalification and low fluidity coal, it is favorable to use black water coal produced in Australia as the middle coalification and low fluidity coal.

EXAMPLE 2

A coal blend is prepared by using X-coal of Table 2 and Y-coal of Table 2 having properties similar to those of X-coal as plural middle coalification and low fluidity coals being main raw materials, A-coal in Table 3 as an example of high coalification coking coal used for reinforcing strength, and C-coal in Table 3 as an example of medium coking coal or hard coking coal indicating a mean reflectance larger than that of middle coalification and low fluidity medium coking coal, and blending them at a ratio of X-coal:Y-coal:A-coal:C-coal=81-y:y:9:10 (Y=0~81).

The test results of mixing X-coal and Y-coal are shown in Table 4. It is possible to mix and use Y-coal with the middle coalification and low fluidity coal having a maximum fluidity (MF) of not less than 3.0 when the mean reflectance ($R_0$) is within a range of 0.9~1.0.

EXAMPLE 3

An operation experiment is carried out by using cokes obtained from the coal blends blending a greater amount of the middle coalification and low fluidity coal according to the invention in Examples 1 and 2 and charging into a blast furnace. The use results are shown in Table 4. In this case, the increase of permeation resistance is somewhat observed in the lower portion of the furnace, but there is no problem in the operation of the blast furnace.

TABLE 4

| Evaluation items | | | ①Blending great amount of middle coalification and low fluidity coal | ②Usual coke | ① - ② | Evaluation |
|---|---|---|---|---|---|---|
| Operation of blast furnace | Air permeation ΔP/V | | 0.252 | 0.254 | −0.002 | — |
| | Index of permeation resistance | Upper portion F2U | 29.3 | 31.3 | −2.0 | — |
| | | Middle portion F2M | 34.6 | 36.0 | −1.4 | |
| | | Lower portion F2L | 167.8 | 162.9 | +4.9 | — (Δ) |
| | Fuel ratio (kg/t) | | 493.5 | 496.0 | −2.5 | ○ (○) |
| Quality of molten iron | Tapping (S) | | 0.0193 | 0.0242 | −0.0049 | ○ (○) |
| | Tapping (Si) | | 0.263 | 0.263 | ±0 | — (Δ) |

INDUSTRIAL APPLICABILITY

As mentioned above, according to the invention, it is possible to produce coke for large size blast furnaces by adopting coal of middle coalification degree and low fluidity having a large inert component, which could not be used in the conventional method of blending a few of each of many brands of raw coals in the conventional coke production for blast furnaces, and blending great amounts of few brands of raw coal. As a result, there can be produced coke for metallurgy at low coat.

What is claimed is:

1. A method of producing coke for metallurgy comprising blending a plurality of raw coals to form a coal blend and carbonizing the coal blend in a coke oven, wherein the coal blend consists of 60~95 wt % of medium coking coal having a content of inert component of not less than 30%, a middle coalification degree and low fluidity, and 5~40 wt % of a high coalification hard coking coal and/or a high coalification medium coking coal having a coalification degree higher than that of the middle coalification degree and low fluidity medium coking coal is used as a coal charged into the coke oven.

2. A method of producing coke for metallurgy according to claim 1, wherein the medium coking coal of middle coalification degree and low fluidity has a equilibrium moisture content of not less than 3.5%.

3. A method of producing coke for metallurgy according to claim 1 or 2, wherein one or more coals having an mean reflectance ($R_0$) as a coalification degree of 0.9~1.1 and a maximum fluidity (MF) as a coking property of not less than 3.0 are used as the medium coking coal of middle coalification degree and low fluidity.

4. A method of producing coke for metallurgy comprising blending a plurality of raw coals to form a coal blend and carbonizing the coal blend in a coke oven, wherein the coal blend consists of 60~95 wt % of medium coking coal having a content of inert component of not less than 30%, a middle coalification degree and low fluidity, and 5~40 wt % of a middle-high fluidity hard coking coal and/or a middle-high fluidity medium coking coal having a maximum fluidity MF larger than that of the medium coalification medium coking coal.

5. A method of producing coke for metallurgy according to claim 1, wherein the high coalification hard coking coal and medium coking coal are coals having an mean reflextance ($R_0$) as the coalification degree of not less than 1.3.

6. A method of producing coke for metallurgy according to claim 4, wherein the middle-high fluidity coking coal and medium coking coal are coals having a maximum fluidity (MF) of not less than 3.0.

7. A method of producing coke for metallurgy according to claim 1, wherein the coke as a product has a tumbler strength ($Tl_6$) as a strength of not less than 83%.

* * * * *

UNITED STATES PATENT AND TRADEMARK OFFICE

CERTIFICATE OF CORRECTION

PATENT NO. : 6,830,660 B1
DATED : December 14, 2004
INVENTOR(S) : Yamauchi et al.

It is certified that error appears in the above-identified patent and that said Letters Patent is hereby corrected as shown below:

Column 1,
Line 54, please delete “guessed” before “obtained”.

Column 3,
Lines 17 and 22, please change “(TIE)” to -- ($TI_6$) --; and
Line 58, please delete “particularly noticed”.

Column 4,
Line 30, please delete “an” after “showing”.

Column 5,
Line 7, please change “(AF)” to -- (A ~ F) --.

Column 6,
Lines 20 and 22, please change “likewise” to -- like --.

Column 7,
Line 16, please delete “paid” before “gradually”.

Column 9,
Line 3, please change “a” to -- an --;
Line 6, please change “an” to -- a -- after “having”, and
Line 8, please change “less” to -- more --.

Column 10,
Line 2, please change “medium” to -- middle --, and after “coalification” please insert -- degree and low fluidity --; and
Line 9, please insert -- hard -- after “fluidity”.

Signed and Sealed this

Thirty-first Day of May, 2005

JON W. DUDAS
*Director of the United States Patent and Trademark Office*